US008365960B1

(12) United States Patent
Kalaouze

(10) Patent No.: US 8,365,960 B1
(45) Date of Patent: Feb. 5, 2013

(54) MULTI-COMPARTMENT BEVERAGE CONTAINER

(76) Inventor: Fadi Kalaouze, College Station, TX (US)

( * ) Notice: Subject to any disclaimer, the term of this patent is extended or adjusted under 35 U.S.C. 154(b) by 754 days.

(21) Appl. No.: 12/496,502

(22) Filed: Jul. 1, 2009

Related U.S. Application Data

(60) Provisional application No. 61/211,139, filed on Mar. 26, 2009.

(51) Int. Cl.
*B67D 7/78* (2010.01)

(52) U.S. Cl. ..... 222/145.5; 222/129; 222/153.07; 222/488; 222/570; 215/6; 220/254.9; 220/501; 220/810; 220/906; 426/115; 206/221; 206/222; 206/229

(58) Field of Classification Search ..... 426/115; 206/217, 219–222, 229, 303, 568; 215/6, 215/10, 227, 306, 311; 220/254.9, 500–502, 220/521–522, 810, 906; 222/129, 136, 145.1, 222/145.5–145.6, 153.07, 164, 166, 325, 222/482, 485, 488, 570
See application file for complete search history.

(56) References Cited

U.S. PATENT DOCUMENTS

| | | | | |
|---|---|---|---|---|
| 3,887,069 | A * | 6/1975 | Diwo | 206/229 |
| 5,071,042 | A * | 12/1991 | Esposito | 222/570 |
| 5,108,003 | A * | 4/1992 | Granofsky | 220/257.2 |
| 6,540,112 | B1 * | 4/2003 | Studnik | 222/132 |
| 7,377,383 | B2 * | 5/2008 | Henry | 206/222 |
| 8,083,055 | B2 * | 12/2011 | Simonian et al. | 206/221 |
| 2004/0007594 | A1 * | 1/2004 | Esch et al. | 222/145.1 |
| 2007/0138179 | A1 * | 6/2007 | Jacobs et al. | 220/254.9 |

* cited by examiner

*Primary Examiner* — Kevin P Shaver
*Assistant Examiner* — Andrew P Bainbridge
(74) *Attorney, Agent, or Firm* — Mark Young, P.A.

(57) ABSTRACT

A beverage container has a lower container section filled with a first liquid. Above the lower container section is an upper container section secured to the lip and groove of the lower section. The upper container section can hold a second different liquid than the first liquid. The upper section defines a mixing channel where openings to both the upper and lower container sections meet to allow the two liquids to mix prior to final dispensation.

20 Claims, 9 Drawing Sheets

MULTI-COMPARTMENT BEVERAGE CONTAINER

CROSS-REFERENCE TO RELATED APPLICATIONS

The present application claims benefit of U.S. Provisional Patent Application Ser. No. 61/211,139, filed Mar. 26, 2009, which is herein incorporated by reference in its entirety.

BACKGROUND OF THE INVENTION

1. Field of Inventions

The field of this application, and any resulting patent, is multi-compartment beverage containers.

2. Description of Related Art

This application, and any resulting patent, relates to multi-chamber beverage containers. People the world over consume mixed drinks—sometimes such drinks are a mixture of alcoholic and non alcoholic beverages, carbonated and non-carbonated beverages, flavorings and water, nutritional supplements and water, or any combination of fluids and/or fluid compatible ingredients. Sometimes the combination of such ingredients may produce an unsavory flavor if they are mixed with one another for some extended period of time. One component may settle, absorb carbonation or otherwise react with the other components. Usually, the flavor of these mixed drinks is optimized by consuming the beverage immediately after mixing the constituents. As a result, the component fluids are usually kept in separate containers until they are mixed.

For example, when a beverage such as a wine spritzer is mixed, the wine and carbonated beverage are mixed only immediately before consumption. Otherwise, the adverse affect of the wine and carbonated beverage when they are combined for some extended period of time would render the drink unpalatable. The wine often acquires a bitter taste, while the carbonated beverage becomes "flat." The same general effects are observed as an alcoholic beverage such as rum is mixed with cola or fruit juice.

Because of the adverse effects associated with the extended mixing of certain components of common mixed drinks, these components are often stored separately until immediately before consumption. Individuals must therefore mix drinks. Not only is such mixing tedious, but the process is inherently imprecise, resulting in some drinks that are much stronger or weaker than others. Additionally, the ingredients are stored separately and tend to be depleted at different times, making it difficult to maintain an inventory of adequate amounts of all constituents of a mixed drink.

Recognizing the advantages that a multi-compartment container would provide, innovators have conceived various multi-chamber containers over the years, including structures disclosed in the patents appearing on the face of this patent. However, those structures do not have all the features of the structures covered by the patent claims below, and the structures claimed in this issued patent solve many of the problems found in many of the structures in those earlier patents, have unpredictable benefits, and overcome many shortcomings inherent in those earlier structures.

SUMMARY OF INVENTION

Although the inventions referenced herein are defined by the claims, in general this patent disclosure relates to beverage containers that include an upper container section configured to engage and be disposed adjacent and above a lower container section that includes a wall defining an interior space that is capable of holding a first liquid beverage, which upper container section includes a wall defining an interior space that is capable of holding a second liquid beverage; and a mixing channel, which includes: a channel wall; an interior mixing space bounded at least in part by the channel wall; a lower opening through which any first liquid beverage is capable of passing from the lower container section to the interior mixing space; one or more intermediate openings in the channel wall through which any second liquid beverage is capable of passing from the upper container section to the interior mixing space; and an upper opening through which any liquid in the interior mixing space is capable of passing to a location outside the beverage container.

Figure 1:
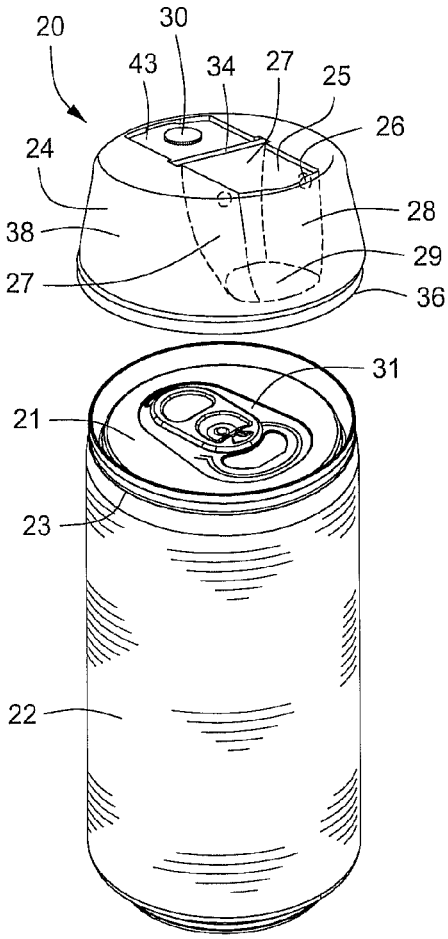
FIG. 1 is a perspective drawing of an upper container section and a beverage can.

Those skilled in the art will appreciate that the figures are not intended to be drawn to any particular scale; nor are the figures intended to illustrate every embodiment of the invention. The invention is not limited to the exemplary embodiments depicted in the figures or the configuration, shapes, relative sizes, ornamental aspects or proportions shown in the figures.

DETAILED DESCRIPTION

1. Introduction

A detailed description will now be provided. The purpose of this detailed description, which includes the drawings, is to satisfy the statutory requirements of 35 U.S.C. §112. For example, the detailed description includes disclosure of the inventors' best mode of practicing the inventions, a description of the inventions, and sufficient information that would enable a person having ordinary skill in the art to make and use the inventions referenced in the claims. In all the Figures, like elements are indicated by like reference numerals regardless of the view in which the elements appear. The Figures are intended to assist in the description, and to provide a visual representation of certain aspects of the subject matter described herein. Those Figures are not drawn to scale, nor are they intended to show all the structural details of product tanks, nor to limit the scope of the claims.

Each of the appended claims defines a separate invention, which for infringement purposes is recognized as including equivalents of the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology. Various terms as used herein are defined below, and those definitions should be adopted when construing the claims that include those terms, except to the extent a different meaning is given within the specification or in express representations to the Patent and Trademark Office (PTO). To the extent a term used in a claim is not defined below, or in representations to the PTO, it should be given the broadest definition persons in the pertinent art have given that term as reflected in printed publications, dictionaries and issued patents.

2. Selected Definitions

Certain claims include one or more of the following terms, which as used herein, are expressly defined as follows.

The term "container" as used herein has a broad meaning, and includes any solid (preferably either flexible or rigid) structure that is capable of containing (holding) a liquid. Preferably, any container referenced herein has one or more side walls that are substantially vertically disposed such that any liquid located between those side walls is thereby contained by the sidewalls. Certain containers disclosed herein are substantially cylindrical, so that they can be regarded as having a single circumferential sidewall that forms a container in the shape of a cylinder, and any "substantially cylindrical" container includes (for example) a beverage can (such as any conventional soft drink can) as well as a beverage bottle (such as any plastic soft drink bottle). For example, a "container" can be any of the multi-compartment containers shown in the drawings that have two or more separate compartments, each compartment capable of separately holding (containing) a different liquid without mixing of the liquids. As used herein, the term "container" can also refer to any one of the individual compartments that make up the larger containers. For example, in certain descriptions herein, a "multi-compartment container" can be said to include an upper container section and a lower container section. That upper container section may also be referred to, alternatively, as either an "upper compartment" or an "upper container." Similarly, that lower container section may also be referred to as a "lower compartment" or a "lower container."

The term "channel" as used herein has a broad meaning, and includes any conduit through which liquid can flow. Preferably, any "channel" referenced herein also includes walls (e.g., side walls). Preferably, the channel has an interior portion (which can also be referred to equally as an inner portion or an inside portion or an inner space or inside space). Preferably, the channel includes an inner surface that defines the interior/inner/inside portion (space) of the channel. Preferably, any liquid is capable of flowing through that interior/inner/inside portion (space). Preferably, the channel has two substantially opposing ends, and each of those opposing ends have openings (which can also be referred to as apertures), e.g., a lower end opening and an upper end opening. As exemplified in the drawings herein, a preferred channel is a conduit that includes a lower opening through which a first liquid can enter and an upper opening through which that same first liquid can exit alone or in admixture with another liquid. Accordingly, after entering through the lower opening that first liquid passes (flows) through the conduit and then exits through the upper opening, preferably after mixing with the second liquid. Preferably, the channel includes an outer surface that is in contact with the internal space (interior) of a compartment (e.g., an upper container section) that preferably holds (contains) a second liquid.

At least one specific type of channel that is described herein is a mixing channel. As used herein, the term mixing channel is a channel that is capable of receiving two different liquids from two different compartments (container sections) and providing a space in which those liquids are capable of mixing. As exemplified in the drawings herein, a multi-compartment container (or an upper container section) can include a mixing channel, which can have a side wall.

The terms "upper" and "lower" are broad terms that encompass any conventional understanding of those terms. Those terms (upper and lower) are understood and defined herein to have meanings that are relative to one another. That is, for example, each of those terms can be used comparatively to refer to the same type of structure or element. For example, any "upper" structure (e.g., upper container section or upper channel opening) has a higher elevation when compared to any "lower" similar structure (e.g., lower container section or lower channel opening), when the container of which that structure or element is a part is placed on a conventional flat surface, e.g., a table top, so that the surfaces for the liquids in the various container sections (e.g., the upper and lower compartments) are substantially horizontal. But as discussed elsewhere herein, the multi-compartment container is designed to be capable of being tilted, so that the surfaces of the liquids in the containers become canted away from the horizontal. As an alternative to "upper" and "lower," the terms "first" and "second" may also be used. Thus, for example, a multi-compartment beverage container can have a first container section and a second container section. It should be understood that the upper and lower container sections, while similar in that they are both containers that are capable of holding liquids, can be different in shape, size and material. Those differences can be seen in the drawings. For example, an upper container section can be made out of a rigid plastic while a lower container section can be made of a metal, e.g., aluminum.

As used herein, the term "first liquid" refers to any liquid that, before any mixing of liquids takes place, is contained (housed or held) in a lower container section, which is preferably considered a "primary" container section. The term "second liquid," as used herein, refers to any liquid that, before any mixing of liquids takes place, is contained (housed or held) in a second container section, which is preferably considered a "secondary" container section. For example, if a rum and cola are to be mixed in a mixing channel to form a rum and cola mixture, before the mixture is introduced to the mouth of a person who drinks the mixture, the cola will typically be the first liquid (being contained in the lower or primary container section) and the rum will typically be the second liquid (being contained in the upper or secondary container section.)

The term "wall" refers broadly to any solid structure that has opposing surfaces (e.g., an inside surface and an outside surface) and is capable of separating two spaces or defining two spaces, e.g., the inside and outside of a container. The term "wall" is not limited to any particular size, shape, curvature or configuration. Certain walls described herein are planar, while others are cylindrical. Other walls are "substantially planar" (a term that encompasses not only a strictly planar wall but also a wall that has a certain insubstantial degree of curvature). Other walls are "curved," which as used herein broadly includes any wall that is convex including a wall that is dome-shaped or arcuate-shaped. The term "wall" may be used in its plural form ("walls") to refer to a combination, collection, or configuration of structures each of which may separately be considered an individual wall, although the combination, collection, or configuration may also be referenced collectively using the singular term "wall."

3. Certain Specific Embodiments

Now, certain specific embodiments are described, which are by no means an exclusive description of the "invention." Also, although other specific embodiments including those referenced in the drawings, are encompassed by this application, and any patent that issues therefrom.

One or more specific embodiments disclosed herein include a beverage container, comprising (including): an upper container section configured to engage and be disposed adjacent and above a lower container section that includes a wall defining an interior space that is capable of holding a first liquid beverage, which upper container section includes a wall defining an interior space that is capable of holding a second liquid beverage; and a mixing channel, which includes: a channel wall; an interior mixing space bounded at least in part by the channel wall; a lower opening through which any first liquid beverage is capable of passing from the lower container section to the interior mixing space; one or more intermediate openings in the channel wall through which any second liquid beverage is capable of passing from the upper container section to the interior mixing space; and an upper opening through which any liquid in the interior mixing space is capable of passing to a location outside the beverage container.

In any of the beverage containers disclosed herein, at least one of the intermediate openings can be smaller than the lower opening.

In any of the beverage containers disclosed herein, at least one of the intermediate openings can be positioned at a location in the channel wall that is closer in distance to the upper opening of the mixing channel than to the lower opening of the mixing channel.

In any of the beverage containers disclosed herein the interior space can include a top portion and a bottom portion, wherein the top portion can be positioned above the bottom portion when the upper container section is upright, wherein the bottom portion can be capable of holding the second liquid beverage such that the bottom portion is devoid of the second liquid when the upper container section is upright, and wherein at least one of the intermediate openings can be positioned at a location in the channel wall in fluid communication with the top portion but not the bottom portion.

In any of the beverage containers disclosed herein, the at least one of the intermediate openings can be positioned at a location in the channel wall that is closer in distance to the outer wall of the upper container section than to the central axis of the beverage container.

In any of the beverage containers disclosed herein, at least one of the intermediate openings can be positioned at a location in the channel wall that is closer in distance to the central axis of the beverage container than to the outer wall of the upper container section.

In any of the beverage containers disclosed herein, one or more of the intermediate openings in the channel wall can include at least one opening capable of providing for the flow of a second liquid beverage from the upper container section to the interior mixing space; and at least one opening capable of providing for the flow of air between the interior mixing space of the mixing channel and the interior of the upper container section.

In any of the beverage containers disclosed herein, the upper container section can include an upper wall and further can include a lower wall disposed between the upper wall and the lower container section, and the lower wall can have a concave surface.

In any of the beverage containers disclosed herein, the upper container section can include an upper wall and further can include a lower wall disposed between the upper wall and the lower container section, and further can include a side wall and a planar member positioned in the space bounded by the upper wall, the lower wall and the side wall that provides reinforcement and rigidity to the upper container section.

In any of the beverage containers disclosed herein, the intermediate openings in the channel can be disposed vertically so that liquid in the upper container section is capable of flowing vertically from the upper container section to the interior mixing space of the mixing channel.

In any of the beverage containers disclosed herein, the mixing channel can have a substantially cylindrical side wall.

In any of the beverage containers disclosed herein, the upper container section can include an upper wall and further can include a lower wall disposed between the upper wall and the lower container section, wherein the lower wall can have a concave surface defining a dome-shaped space between the lower container section and the concave surface and wherein the mixing channel can extend from the dome-shaped space to the upper wall of the upper container section.

In any of the beverage containers disclosed herein, the lower container section can be a metal soft drink can capable of holding a soft drink.

In any of the beverage containers disclosed herein, the lower container section can be a plastic soft drink bottle capable of holding a soft drink.

In any of the beverage containers disclosed herein, the lower container section can include a hinged lid capable of rotating from a closed position in which the upper opening of the mixing channel is closed, to an open position in which the upper opening of the mixing channel is open.

In any of the beverage containers disclosed herein, the upper container section can include a collar that is capable of attaching the upper container section to the lower container section.

In any of the beverage containers disclosed herein, the upper container section can include a filling aperture through which the second liquid can be introduced to the interior of the upper container section.

In any of the beverage containers disclosed herein, the mixing channel can include a flexible planar tab member that has adhesive on one side and is removably adhered to an inner surface of the channel side wall so that at least one of the one or more intermediate openings in the channel wall is closed, and so that the flexible planar tab member can be removed to open the intermediate opening.

In any of the beverage containers disclosed herein, the lower container section can be a plastic soft drink bottle with a threaded upper opening, the upper container section can include a channel with threads that are capable of being affixed to the threaded upper opening of the soft drink bottle by screwing the upper container section to the lower container in a clockwise direction.

4. Specific Embodiments in FIGS. 1-24

Figure 2:
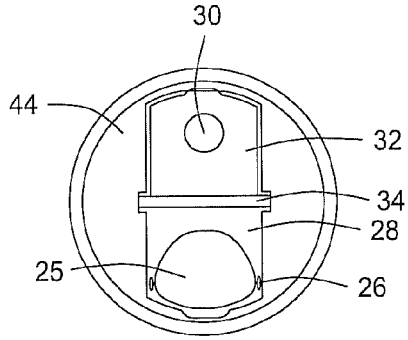
FIG. 2 is a top view of the upper container section in FIG. 1.
Figure 3:
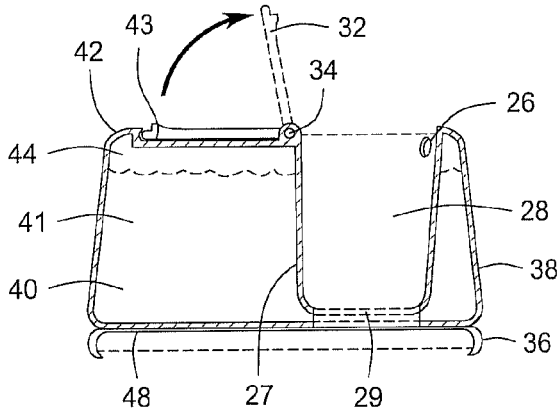
FIG. 3 is a cut-away side view of the upper container section shown in FIG. 2.

Referring to FIGS. 1-3, an embodiment (example) of a beverage container is illustrated, which has features any one of which may be found in other specific embodiments, including both those that are shown in this specification and those that are not shown. Any beverage container disclosed herein, including the beverage container shown in FIGS. 1-3, may alternatively be referred herein to as a "device" or "apparatus," and any features or aspects of the beverage container may be referred to herein as elements, components, limitations or devices. For example, certain elements of any beverage container disclosed herein can themselves be regarded as devices, such as the upper container section.

Referring to FIG. 1, beverage container 20 includes lower container section 22 which is itself a liquid storage device. The container section 22 in FIG. 1 is a conventional aluminum soft drink beverage can, which has rigid (albeit easily bent) outer walls (although the side walls of a cylindrical beverage can also be referred to as a single continuous side wall). As with typical beverage cans, the can 22 in FIG. 1 includes an upper circumferential rim 23, which includes a lip, which is a feature of many aluminum beverage cans that contain soft drinks, and which in accordance with the detailed description herein can be used to secure the upper container section 24 to the lower container section 22, preferably using the flexible collar 36. Lower container section 22 is representational only, and does not necessarily depict the actual dimensions or proportions of a typical soft drink beverage can. As of the filing date, for example, most (or certainly many) aluminum beverage cans have the upper or top wall 21 of the can (primarily the upper surface portion) is smaller in diameter than the diameter of the overall can; thus the upper rim of the can (which is capable of being coupled to the upper container section 24) has a smaller diameter and circumference than the overall can. Also, the can 22 in FIG. 1 has a structure often referred to as a "pop-top" 31.

Beverage container 20 also includes upper container section 24, which is also a liquid storage device. Section 24 includes an interior space that is capable of holding a liquid beverage. A mixing channel 28 is provided which is also capable of serving as a drinking channel. Mixing channel 28 is disposed within (or through) the upper container section 24 so that a first liquid in the lower container section 22 can pass through the channel from the lower container section without being mixed with any second liquid in the upper container section 24 except and to the extent a second liquid passes from the interior of the upper container section 24 through intermediate apertures 26 and is mixed or otherwise combined in the interior mixing space of the mixing channel 28 with a first liquid. The mixing channel 28 in FIGS. 1-3 has four channel walls 27 which form a barrier between the first and second liquids. Mixing channel 28 also has a lower opening 29 and an upper opening 25. Advantageously, the first and second liquids mix in the mixing channel 28 (e.g., in the interior mixing space) prior to passing through upper opening 25 and being consumed as a mixture. In the device shown in FIGS. 1-3, the intermediate channel apertures (also referred to as openings) 26 are located proximate the top of the mixing channel 28. The intermediate channel openings that provide for the passage of liquid from the interior of the upper container section 24 to the interior of the mixing channel 28 (which may be referred to herein as "intermediate channel liquid openings") are preferably smaller in size (both diameter and circumference) than the lower channel opening 29. In at least one specific embodiment, it is contemplated that the ratio of the size of the lower channel to the combined size of the intermediate channel liquid openings ranges from 5:1 to 10:1. The relative positioning of the intermediate channel openings has an unpredictable benefit, as discussed in greater detail herein. Furthermore, the relative sizes of the intermediate channel openings are also advantageous. At least two surprising benefits of providing an opening size ratio of at least 2:1, such that the ratio of the size of the lower channel opening to the combined size of the intermediate channel liquid openings are: (1) a desirable beverage mixing ratio, i.e., a volumetric mixing ratio of at least 2:1 and preferably from 5:1 to 10:1, ensuring that the mixed drink has proper proportions; and (2) that the second liquid is not consumed before the first liquid is consumed. As seen in FIGS. 1-3, the interior volume of the lower container section 22 is greater than the interior volume of the upper container section 24.

The ratio of the volume of liquid in the filled upper container, $V_u$, to the volume of liquid in the filled lower container, $V_l$, is the filled volumetric ratio $R_f$. In a typical configuration, $R_f$ may be from approximately 1:2 to 1:10, meaning that $V_u$ is about a half to a tenth of $V_l$. The pour ratio, $R_p$, is the volume $V_{uf}$ of liquid capable of flowing from the upper container section 24 to the volume $V_{lf}$ of liquid from the lower container resulting in a mixture that emerges from the upper opening as the beverage is poured, e.g., either into another receptacle, a drinking cup or glass, or directly into an individual's mouth for direct consumption. If the average pour ratio, $R_p$, equals, or approximately equals, the filled volumetric ratio $R_f$, then the liquid from each container section should be entirely consumed at about the same time. Additionally, as the mixed liquid is consumed, on average, the sips should contain approximately the same volumetric ratio of liquid from the upper container section 24 to liquid from the lower container as $R_f$.

By way of example and not limitation, a typical rum and Coke® cocktail can be served in an 8 to 12 fl oz. highball glass with either one or two shots of rum. Each shot of rum contains about 1.5 fl. oz. Thus, the volumetric ratio of coke to rum in a typical rum and Coke® cocktail may vary from about 1:3 to 1:8, depending upon the size of the glass and how much it is filled. The volume of rum is about a third to an eighth of the volume of Coke® in a typical rum and Coke® cocktail.

If the collective or combined sizes of the side channel openings were the same, or greater, than the size of the lower channel opening (or greater than a desired proportionate size), then all of the second liquid would tend to pass to the mixing channel 28 from the upper container section 24 before all of the first liquid would pass to the mixing channel 28 from the lower container section, and there would be an undesirable ratio of mixing and an exhaustion of the second liquid before exhaustion of the first liquid. Accordingly, the relative size of the side channel openings as compared to the lower channel opening is critical.

Sizing of the apertures 26 to achieve a pour ratio, $R_p$, that equals, or approximately equals, the filled volumetric ratio $R_f$ may depend upon a number of variables. One variable is the volume of liquid from the lower container section 22 that emerges into the mixing channel 28 during pouring, which is determined in part by the size of the lower channel opening 29 as well as the pouring angle. Another variable is the viscosity of the liquid in the upper container section 24. A liquid, such as a syrup, sauce or slurry, may have a substantially higher viscosity than the liquid in the lower container section 22, thereby requiring larger apertures.

An imaginary plane of symmetry divides the lower container section 22 into symmetrical halves (upper and lower halves). Typically a beverage is poured by tilting the container about an axis perpendicular to the plane of symmetry. That axis is referred to herein as the pouring axis. In an illustrative embodiment, the apertures 26 in the mixing channel 28 may be positioned in the mixing channel 28 in alignment, or approximate alignment, with the plane of symmetry. Such positioning causes the apertures to pivot about the pouring axis during pouring. If apertures 26 are positioned on opposite sidewalls of the mixing channel 28, then tilting about the pouring axis may cause the aperture(s) in one sidewall to pivot downward below the ullage into the liquid, while the opposite aperture(s) may pivot towards the ullage away from the liquid. Apertures in the ullage above the liquid will act as vents, while those that are submerged in the liquid will act as liquid ports. Further, in a specific embodiment described below, the upper container section has a vertically disposed dividing wall that separates the upper container section into two smaller containers, which may also be regarded as "sub-containers" or compartments, each holding liquids that may be different liquids.

Also included in the device shown in FIGS. 1-3 is a fill element 30, which includes an aperture and may also include a cap or lid such as a strip of adhesive removable tape that is described elsewhere herein. Removable tape is an element that is known to the general public as well as to persons skilled in the beverage container industry. At least one example of a removable tape strip that can be used is the tape used on V8® juice cans, which is not only removable but also replaceable (after removal it can be adhered back to the same location). Preferably, the removable tape strip forms a seal that, when installed, prevents either liquid or gases (including air) from passing through the aperture.

In FIGS. 1 and 3, collar 36 is shown as a pre-formed ring that that is resilient and flexible and is capable of being stretched out (enlarged) and then snapped over the upper rim 23 of the beverage can 22, thus providing one way of coupling the upper container section 24 to the beverage can 22. Although any plastic or elastic material may be used for the collar, an example is the material that is used for rubber bands. Although the collar is shown as being an integral part of the upper container section 24 it may, alternatively, be a separate element. Also, although shown as having a particular width and shape in FIGS. 1-3, the collar is not necessarily limited or restricted to that width or shape. As discussed below, the collar may be an elongated, cylindrical structure that is capable of fitting around and grasping the entire length (or part of the length) of a can 22, instead of snapping over just the rim 23 of the can 22.

The particular apparatus 20 shown in FIGS. 1-3 includes openings 26 that are examples of the intermediate channel openings which are also exemplified in other drawings herein. As seen in FIGS. 1-3, the openings 26 are located in the wall(s) of the mixing channel 28 proximate the top of the mixing channel 28 and also proximate the outer edge of the upper container section 24. The term "proximate" used in the preceding sentence is a relative term, and means the openings 26 are closer to the top of the mixing channel 28 than to the bottom, and are closer to the outer edge of the top or upper wall 42 of the upper container section 24 than to the center of the upper container section 24, e.g., its axis which preferably corresponds approximately to the axis of the overall beverage container 22 and/or to the axis of the can 22.

It is known that beverage containers can be provided with easy opening tape closures comprising a pressure-sensitive adhesive tape applied over a hole. To open such a container, a user either punctures the tape or grasps a free end of the tape and pulls the closure off, exposing the hole in the end wall to permit pouring out the contents of the can. Easy-open tape closures of this type are described in U.S. Pat. Nos. 3,389,827; 4,108,330; 4,135,637; 4,215,791; 4,372,460; 4,378,074 and 4,448,326; the disclosures of which are incorporated herein by reference. Tape closures of this type frequently utilize a tab on one end which the user grasps to peel the tape from the surface of the container to expose the opening. To permit a user to more securely grasp the tape a hole may be provided which is punched in the tape to provide a ring pull for the user. Other tape closures may have a broad tab with embossments or perforations to provide a textured surface to the sides of the tape such that the operator could more easily grasp the surfaces of the normally smooth tape at the free end to peel the tape from the can end.

Figure 24:
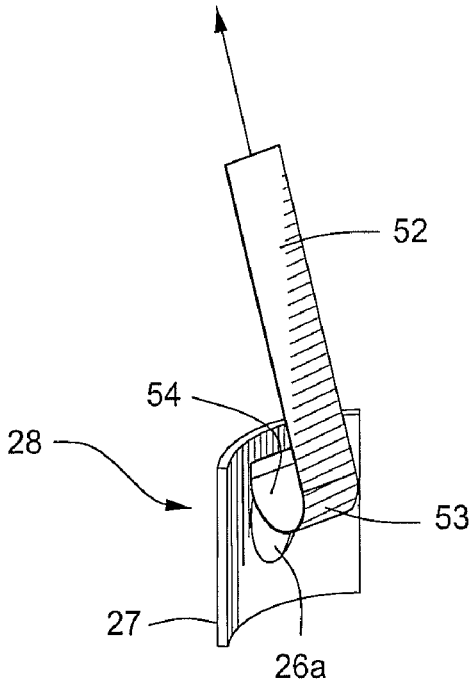
FIG. 24 is a perspective side view of an intermediate aperture with a tab that includes pressure adhesive tape.

Unfortunately, conventional tape removal techniques may not work well with the taped apertures being located in a confined channel. Therefore, in an illustrative embodiment, as shown in FIG. 24, a tape closure 54 provided over each aperture 26 includes an elongated tab 52 that extends through the upper opening 25 to allow a user to grasp and manipulate the tab for removing the tape. To facilitate removal, the tab 52 of each tape closure may extend from the bottom 53 of the tape closure 54. The tab 52 may be folded over the tape closure 54 and extend through the upper opening 25. Thus, tension exerted on the tab during pulling will remove tape by peeling back from the bottom to the top. Additionally, the tabs may be adjoined together or integrally formed, thereby allowing simultaneous removal of a plurality of tape closures.

Preferably, as shown in FIGS. 1-3, the openings 26 (apertures) are closer to the top than to the bottom by a ratio of 4:1 or more; and are closer to the outer edge than the inner center by a ratio of 4:1 or more. A benefit to such positioning of the openings (and, more generally, the intermediate channel openings) is that the second liquid enters the mixing channel 28 only when the beverage container is tilted from the vertical, where "vertical" means the orientation of the beverage container axis when the container is placed on a flat surface, in which case the upper surfaces of the first and second liquids are substantially horizontal and coplanar with the flat surface. In at least a preferred use, an individual uses the beverage container in FIGS. 1-3 by grasping the container with a hand, lifting the container, placing the container with the opening against his mouth and tilting the container so that first liquid from the lower container section enters the mixing chamber. Preferably, until the container is tilted, none of the second liquid passes from the upper container section 24 to the mixing channel 28 (which can also be referred to as a mixing chamber) notwithstanding opening 26 through which liquid is capable of passing (even after the adhesive tabs are removed). Then, when the container is sufficiently tilted, the level of the second liquid in the upper container section 24 rises relative to the openings 26 until it reaches the openings 26, at which time the second liquid passes through the openings 26 to the interior of the mixing channel 28, where it mixes with the first liquid; then after mixing, the mixture of the first and second liquids is passed to the mouth through channel opening 25. Preferably, when the person decides to stop drinking the mixed beverage, he (or she) returns the orientation of the beverage container to the vertical (non-tilted) position. As soon as the upper surface of the second liquid drops below the opening, the second liquid no longer flows into the mixing channel 28. Accordingly, at least one benefit of the positioning of the openings 26 in the mixing channel 28 is the ability to easily control the mixing of the two beverages, i.e., the first and second liquids. Upper container section 24 also includes an interior space, which may also be regarded as a reservoir where the second liquid 40 is contained. Referring to FIG. 3, it can be seen that a second liquid 40 occupies at least the lower portion of the reservoir, which provides an unfilled upper space 44 (sometimes referred to as "ullage"). Other features of the device in FIGS. 1-3 include the side wall 38 of upper container section 24, which may be slightly canted (sloped); an upper or top wall 42 that includes a recessed portion, e.g., recessed surface 43 to accommodate the hinged flip-top 32 that is capable of rotating or swinging from an open position to a closed position (as illustrated in FIG. 1, the filling element 30 can be located in the recessed portion 43 of the upper or top wall 42); and a flip-top member 32 that includes a hinge 34.

As discussed below, the upper container section can be composed of two smaller compartments that can be regarded as sub-containers or sub-compartments, each of which can hold different liquids. Each of the liquids can be considered a "second liquid" as that term is used herein. Alternatively, one of the liquids can be considered a second liquid while the other liquid can be considered a third liquid. For example, when a first liquid in the lower container section is a non-alcoholic "mixer," two different alcoholic liquids can be used as second and third liquids, respectively, each occupying different sub-containers or compartments in the upper container section. Also, preferably, a channel wall can have at least two separate intermediate channel openings 26*a* through which a second liquid (or a third liquid) is capable of passing, from the upper container section (or, alternatively expressed, from either a first upper container section or a second upper container section) to the interior mixing space of the channel. Preferably, the wall of the channel 28 also has two separate intermediate channels 26*b*, positioned so that air can enter the first or second upper container sections, to provide for an equilibrium of pressure as described elsewhere herein.

Figure 4:
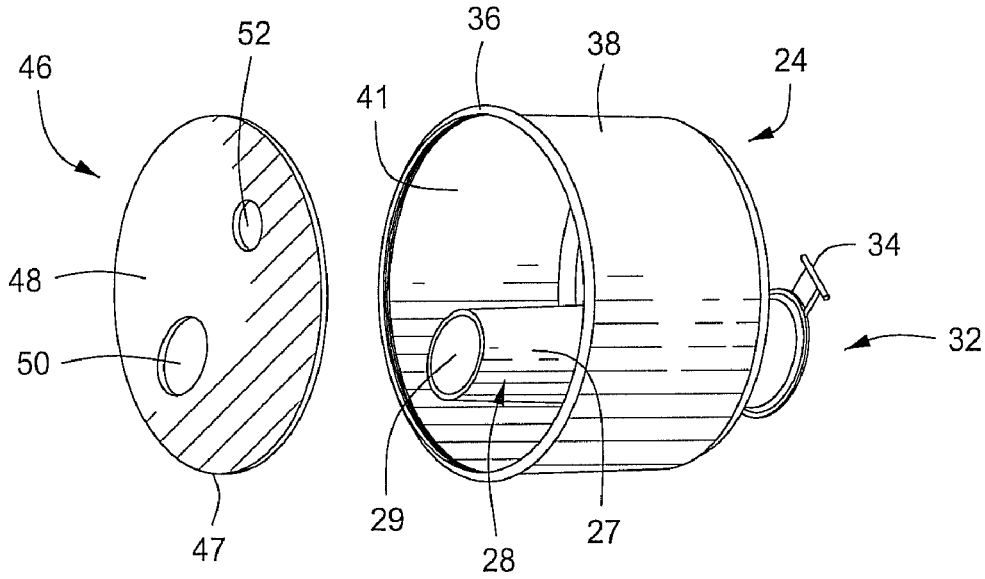
FIG. 4 is a perspective drawing showing an example of an unassembled upper container section, from the bottom, including a flip-top.
Figure 5:
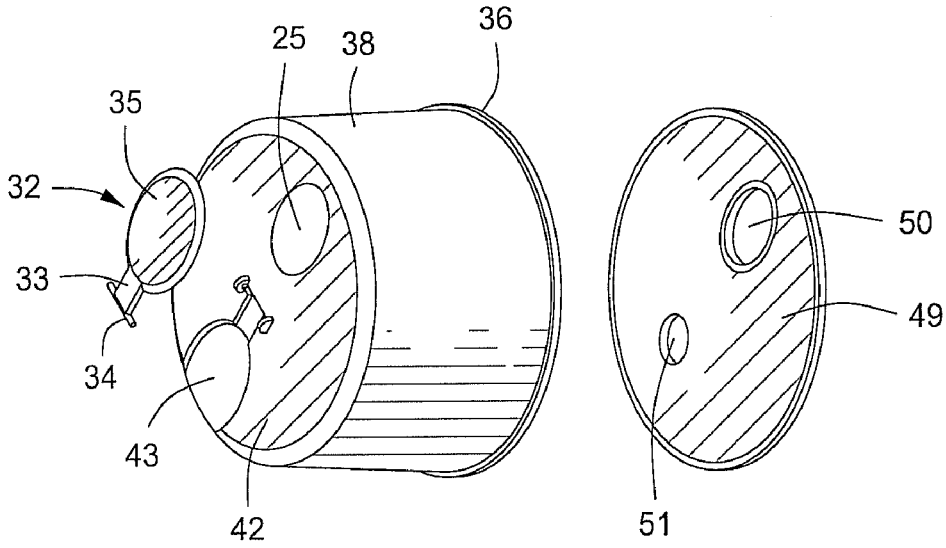
FIG. 5 is a perspective drawing showing an example of the unassembled upper container section in FIG. 4, from the top.

Referring to FIGS. 4-8, a specific embodiment (example) of an upper container section 24, at least partially unassembled, is disclosed. This upper container section 24 is preferably dimensioned and shaped to fit on top of a conventional soft drink beverage container (not shown), which is capable of functioning as a lower container section. As seen in FIGS. 4 and 5, the upper container section 24 can be constructed of several walls that are sub-sections (or sub-parts) that fit together to form an assembled upper container section 24. One subsection can include an outer wall 38, which extends circumferentially and forms a substantially cylindrical shape and partially defines an inner container space where a second liquid can be held. That subsection can also include a flexible collar 36, which is described elsewhere herein. That subsection can also include a flip-top 32 which can include a hinge 34. Although described as being a part of the upper container section 24, the flip-top 32 may also be regarded as being separate from the upper container section 24. Another feature seen in FIG. 4 is a mixing channel 28, which is substantially cylindrical (i.e., having an elliptical or oval cross-section), and includes a mixing channel side wall 27 that has an outer surface and an interior mixing space 29. At least a portion of the space between the outer surface of the mixing channel 28 (or the side wall) and the inner surface of the container wall 38 forms the interior 41 of the upper container section 24 where the second liquid 40 resides or can be found.

Also seen in FIG. 4 is a lower member 46 of the upper container section 24 which can be referred to as a wall or divider and can be adjoined or otherwise coupled (preferably permanently fixed by ultrasonic welding or glue or the like). The outer edge or rim 47 of the lower member 46 is shaped to fit either against the lower edge of wall 38 of the main subsection, or slightly inside that inner surface of wall 38, so that a liquid-tight seal is formed between member 46 and the inner surface of wall 38. The lower member 46 in FIG. 5 is substantially planar although (as discussed elsewhere herein) it can alternatively be dome-shaped or have some other curved, arc-shaped or concave shape with the uppermost part of the dome reaching toward the direction of the interior 41 of the upper container section 24. Also, as shown in other drawings, that lower member can include a recess to accommodate the "pop-top" 31 of a typical beverage can. That lower member 46 has a lower or bottom surface 48 and preferably includes at least two openings 50 and 52 (also referred to as apertures). The smaller aperture 52 is capable of providing for the introduction of the second liquid into the interior of the upper container section 24, much like the filling element 30 shown in FIGS. 1-3. Preferably a covering such as a lid (not shown) is provided so that, once the second liquid is added to the interior of the upper container section 24, it can be sealed shut. An example of the lid or other covering is the aluminum adhesive tape strip referenced elsewhere herein. Preferably, the covering, e.g., the adhesive tape, is not only removable, but is also replaceable, so that a second liquid can be added multiple times, and the upper container section 24 re-used after that second liquid that is initially added is consumed. In the specific embodiment in FIG. 4, the second aperture 50 is shaped and sized to correspond to the lower opening of the mixing channel 28.

Referring to FIG. 5, the lower member can be seen from the opposite side as the side seen in FIG. 4. The section seen in FIG. 5 reveals inside surface 49 which along with the inner surface of wall 38 and outer surface of the mixing channel wall 27, forms the interior of the upper container section 24. Also seen in FIG. 5 are the two apertures 50 and 51, which are discussed above with reference to FIG. 4. Also seen in FIG. 5 is the upper wall 42 of the upper container section 24 which includes an upper surface and a lower surface (not shown). FIG. 5 shows the flip-top device 32 and the different subparts, including the main cover 35, the neck 33 and the hinge 34. As seen in FIG. 5, there can be a recess or indentation 43 where the flip top 32 can rest or be inserted when the flip top is in an open position and does not cover the channel opening 25.

Figure 6:
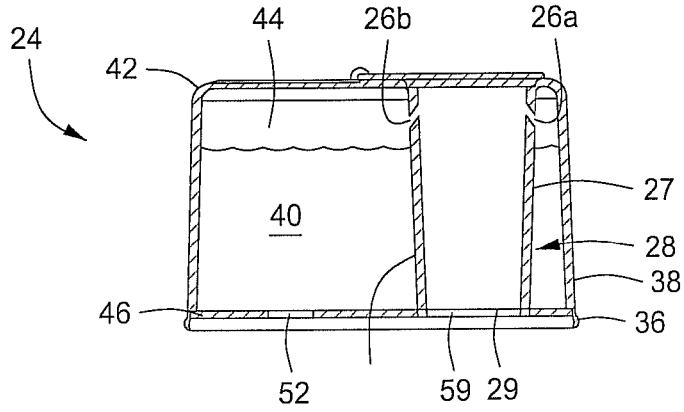
FIG. 6 is a cut-away side view of another example of an upper container section that includes a beverage.
Figure 7:
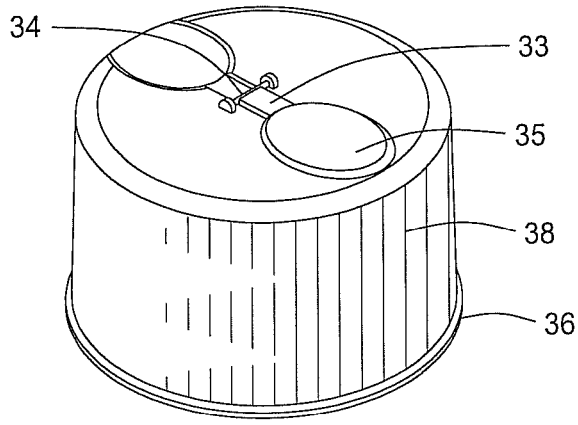
FIG. 7 is a perspective top view of the upper container section shown in FIG. 6.
Figure 8:
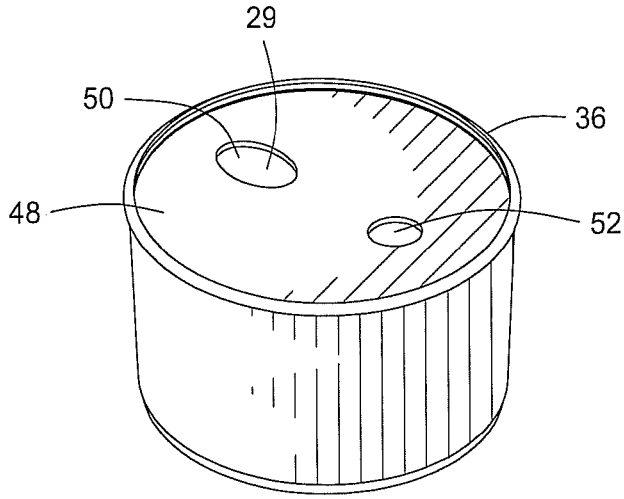
FIG. 8 is a perspective bottom view of the upper container section shown in FIG. 7.

FIGS. 6-8 show substantially the same type of upper container section 24 that is disclosed in FIGS. 4-5, but from a different viewpoint. Also, unlike the upper container section 24 in FIGS. 4-5, the section in FIGS. 6-8 is assembled, and is ready to be adjoined to the lower container section, e.g., a beverage can (not shown). Referring to FIG. 6, there is shown an upper container section 24 that is capable of holding a second liquid 40, in which case an ullage 44 is defined as well. Also shown is a side wall 38, upper or top wall or member 42, lower or bottom wall or member 46, a mixing channel 28 that includes a substantially cylindrical channel wall 27 with an outer surface and intermediate channel apertures 26*a* and 26*b*. Aperture 26*a* preferably serves as a second liquid aperture, e.g., an aperture through which the second liquid can enter the mixing channel 28, preferably when the upper container section 24 is tilted (rotated clockwise).

Referring to FIG. 6, aperture 26*b* is preferably a vent, which permits air to enter from the interior space of the mixing channel 28 to the ullage 44 of the upper container section. Advantageously, when an appropriate amount of second liquid is added to the interior of the upper container section, and the upper container section is placed in an upright position, then the upper surface of the second liquid is horizontal, air is capable of freely flowing in either direction through aperture 26*b*, depending on how the air pressure is distributed, and pressure equilibrium is maintained between the ullage 44 and the mixing channel 28. A strip of adhesive tape (not shown) may be placed over the aperture 26*b*, to insure that no contaminants enter the interior of the upper container section 24, and to insure that none of the second liquid inadvertently escapes. When the upper container section 24 is tilted (e.g., rotated clockwise) the second liquid enters the interior space of the mixing channel 28 through aperture 26*a*. When the second liquid exits the interior of the second container, the pressure drops in that interior, and air enters through to the interior through vent 26*b* to maintain pressure equilibrium inside the second container. If the vent 26*b* were not present, then a vacuum would form inside the second container section, which would prevent or at least inhibit the second liquid from freely flowing into the mixing chamber. Although the aperture 26*b* in FIG. 6 is shown as a single small opening, it is contemplated that, in the alternative, multiple openings may be provided.

FIG. 6 also shows an example of how the lower or bottom section or wall 46 of the upper container section 24 can be located relative to the flexible collar 36. It is understood that both the lower (bottom) section (wall) 48 and the collar 36 in FIGS. 6-8 do not necessarily have the particular dimensions or shape that are shown. For example, as discussed elsewhere herein, the lower (bottom) section can be dome-shaped to accommodate the pop-top of a soda can. Also, instead of the collar 36 shown in FIGS. 6-8, a collar can be constructed of a shape and material that does not necessarily expand and contract to snap over the rim of the lower container section, e.g., a soda can, but that includes a structure that is nevertheless capable of gripping the lower container section. For example, a collar may be provided that is cylindrical and extends along the entire length of the lower container section (not shown). It may be a flexible material that includes cloth or non-woven fabric or plastic such as nonwoven polypropylene and may also include a fastener such as tape or Velcro®. An example of a flexible cylindrical structure that can be used as a collar is a Koozie® that can be secured around a second container, e.g., a beverage can. In one or more specific embodiments, however, it is important that the upper container section 24, holding the second liquid, be secured against the lower container section, so that first liquid can pass (flow) from the lower container section into the mixing channel 28 without leakage.

Figure 9:
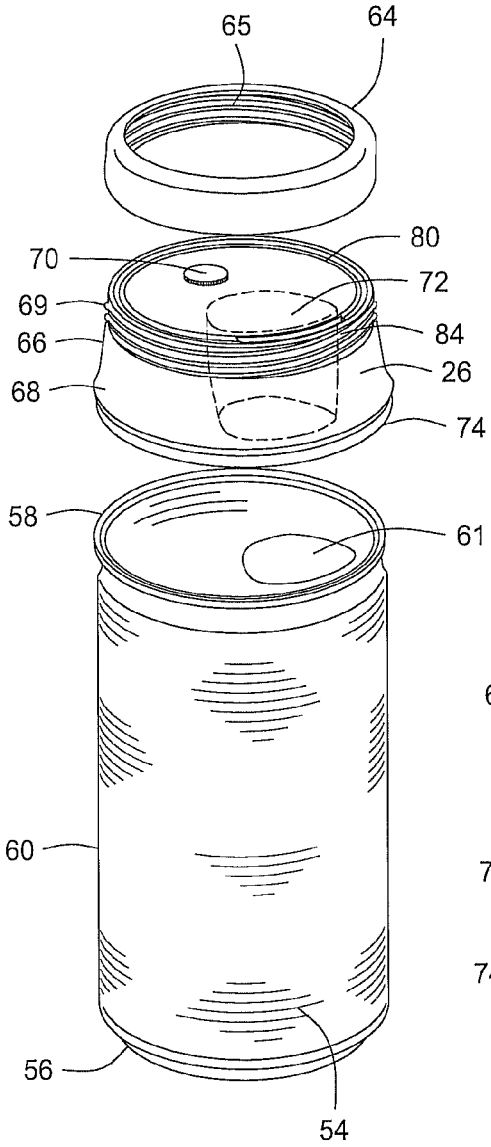
FIG. 9 is a perspective drawing of another example of an upper container section and a beverage can.
Figure 10:
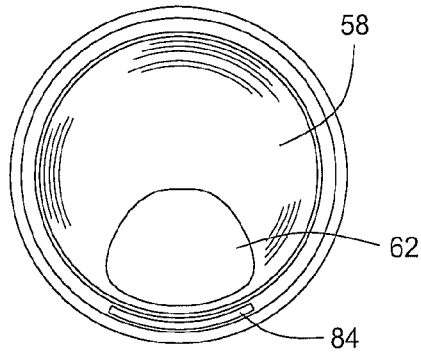
FIG. 10 is a top view of the upper container section in FIG. 9.
Figure 11:
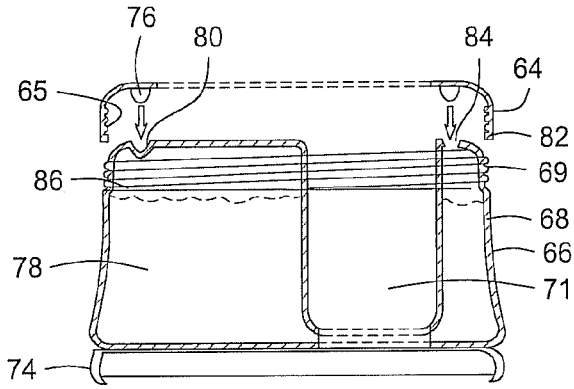
FIG. 11 is a cut-away side view of the upper container section shown in FIG. 10.

Now referring to FIGS. 9-11, yet another alternative embodiment is shown, which includes a lower container section for a first liquid beverage, an upper container section for a second liquid beverage and a mixing channel. A rigid mixing beverage container 66 has rigid walls 68 with exterior threads 69, a filling element 70, a formed plastic bottom 74, which is a type of collar, and which is capable of snapping onto the fluid storage device 60 (can in this embodiment), a top with a groove 80, a mixing channel 72 which extends through the mixing beverage container 66 with an opening 84 cut into the groove 80 of the top, an adjustable lid 64 with interior threads, an O-ring 76 attached to the adjustable lid 64 and a reservoir 86 for storing the mixing beverage 78. This particular apparatus includes an upper liquid opening 84, which is cut in the groove proximate the mixing channel, allowing access to the reservoir, i.e., an aperture through which liquid can flow. Also seen in FIGS. 9-11 are a lower container section 60 which has a bottom portion 56 and a cylindrical side wall 54. That lower container section also has an upper rim 58 that is capable of being adjoined or otherwise coupled to the upper container section 24, preferably via the collar 74. Also disclosed is an opening 61 in the beverage can 60 through which a first liquid can pass into the mixing channel specifically into the interior space 71 of the channel Referring to FIG. 10, there is shown a view of the upper surface 58 of the upper container section, which view does not show opening 70 by which a second liquid can be added to the interior of the upper container section, but which view does show an example of a cross-section of the mixing channel, which can be substantially cylindrical as seen therein, but can nevertheless be irregular in cross section. The beverage container in FIGS. 9-11 does not include a hinged flip top as seen in other specific embodiments. In at least one specific embodiment, the upper portion 64 can include a top panel covering (not shown) with an opening the same size as the upper opening of the mixing channel, such that the upper portion 64 can be rotated so that aperture 84 leading from the interior of the upper container section to the mixing channel is opened, and the opening in the top panel is in alignment with the upper opening of the mixing channel. When the threaded top 64 is rotated so that the slot does not align with the aperture 84, then the two openings also do not align, and the upper opening of the mixing channel is effectively closed.

Figure 12:
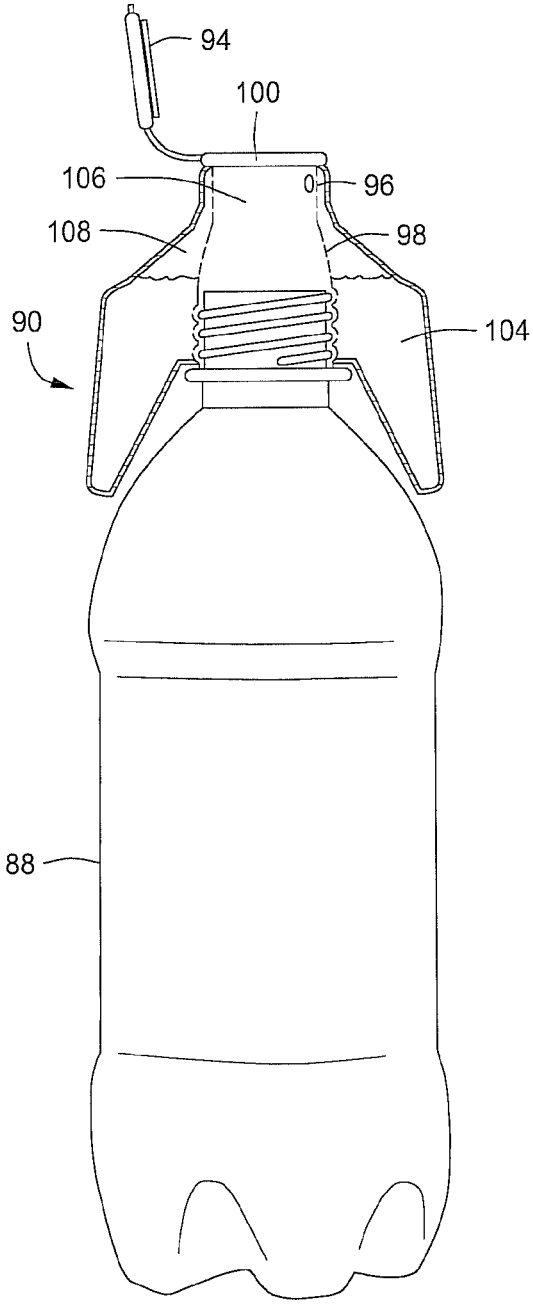
FIG. 12 is a perspective drawing of another example of an upper container section and a beverage bottle.
Figure 13:
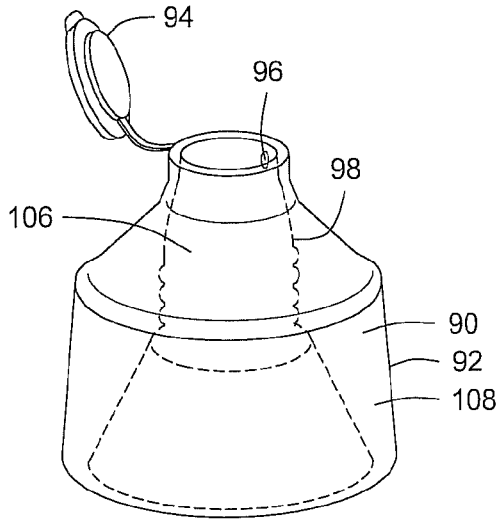
FIG. 13 is a perspective top view of the upper container section in FIG. 12.
Figure 14:
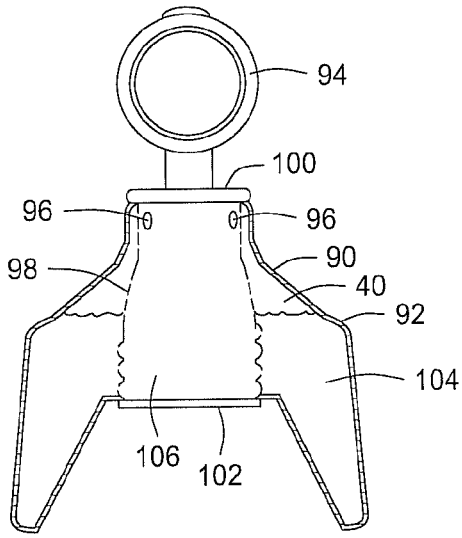
FIG. 14 is a cut-away side view of the upper container section shown in FIG. 13.

Referring to FIGS. 12-14, an alternative embodiment is shown, which includes a lower container section for a first liquid beverage, an upper container section for a second liquid beverage and a mixing channel. In this embodiment, the apparatus includes a rigid mixing beverage container 90 with rigid outer walls 92, rigid interior walls 98 that include molded threads that can be screwed to the threaded top of a conventional plastic soft drink bottle, a mixing channel that has an upper opening 100, at least one intermediate channel opening 96. As seen in FIG. 14, there is preferably another intermediate channel aperture is located on the opposite side of the mixing channel to provide for the flow of air from the mixing channel into the interior of the upper container section 90 while liquid is flowing out of the upper container section into the mixing channel through aperture 96. Also shown in FIGS. 12-14 is the second liquid 104, the interior space of the upper container section, a thin rubber gasket 102. Note that, advantageously, the upper container section is secured to the lower container section using the threaded section of the upper container section that includes a mixing channel. Also included in the device shown in FIGS. 12-14 is a flip top 94 that is hingedly secured to the upper container section via a flexible member.

Figure 15:
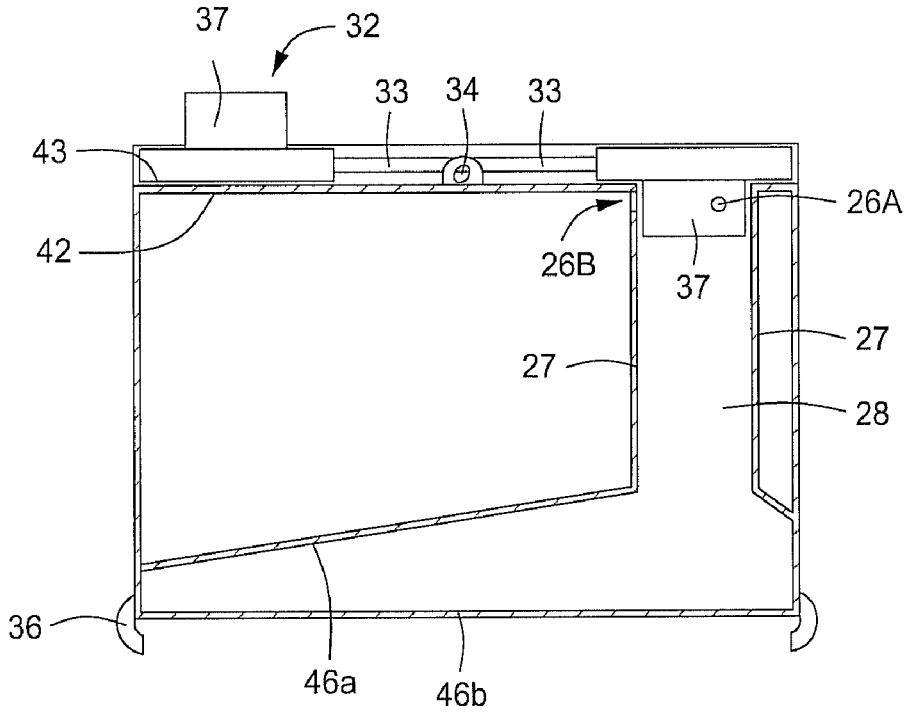
FIG. 15 is a cut-away side view of another example of an upper container section.
Figure 17:
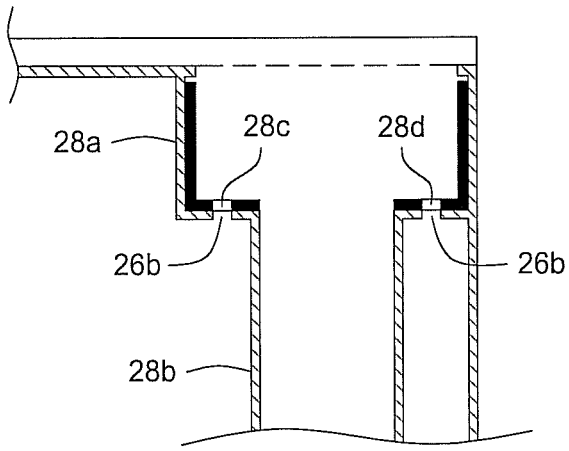
FIG. 17 is a cut-away side view of a portion of another example of an upper container section.
Figure 18:
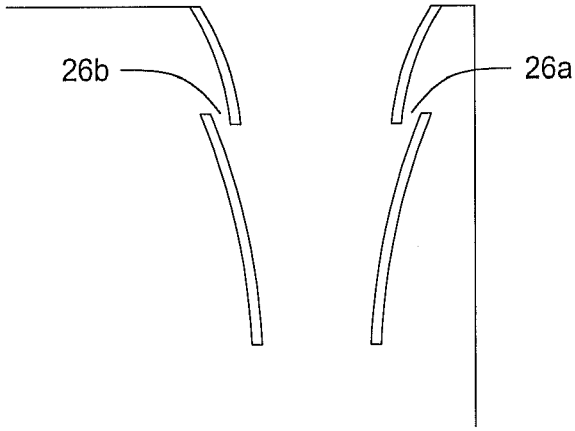
FIG. 18 is a cut-away side view of a portion of another example of an upper container section.
Figure 19:
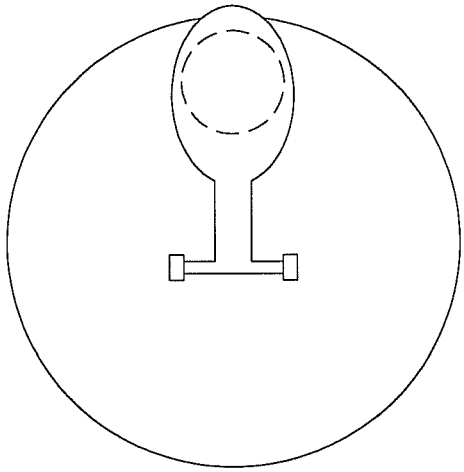
FIG. 19 is a top view of the upper container section in FIG. 19.

The drawings in FIGS. 15-19 show other examples of upper container sections, and other examples of features of upper container sections. Those upper container sections and the features thereof are, in certain respects, similar to the upper container sections and features in FIGS. 1-3 and/or FIGS. 6-8. For example, all are configured to be coupled to a beverage can. Accordingly, some of the reference numbers for elements or features will be the same, although the use of the same reference numbers is not intended to restrict or limit their scope, or the scope of the claims, in any respect. As seen in FIG. 15, the upper container section 24 includes an upper wall 42, which (based on the location of the cross-section) includes indentation or recess 43 to accommodate flip-top 32, including neck 33 and hinge 34. In one specific embodiment, the flip-top 32 includes extension tabs 37 so that, when the flip-top 32 is closed, the extension tabs close the intermediate liquid channel apertures 26*a*. In the upper container section 24 in FIG. 15, two intermediate liquid channel apertures 26*a* are located on the opposing sides of the mixing channel 28, and are blocked or closed when the flip-top is lowered so that the extension tabs 37 cover the apertures 26*a*. Alternatively, in another specific embodiment, the structure 37 shown in FIG. 15 is not an extension tab, but rather is a cylindrical, elastic, gasket-like plug (viewed from the side) that fits tightly into the upper portion of the channel 28 and, advantageously, not only plugs the upper channel opening 25 but also plugs (e.g., blocks and preferably seals) each of the channel apertures 26*a*, 26*b*. Because it is elastic, it can be removed. As illustrated in FIG. 19, the flip-top can have a portion that hangs over the edge, so that it can be removed easily by flicking upward with a thumb. Also seen in FIG. 15 is an intermediate channel aperture 26 that is positioned closer to the center and is a vent for air. The upper container section in FIG. 15 includes a lower wall 46 that is convex or dome-shaped, so that the pop-top of a conventional beverage can preferably easily fit into the space defined by the convex lower wall 46. Accordingly, as depicted in FIG. 15, lower wall 46 includes surface 46*b*, which defines the lower outer circumferential edge of the wall that conforms to, or fits against, the upper rim of any beverage can (not shown) and convex or dome shape of the surface extends away from the upper surface of the lower container section. Accordingly, surface 46*a* curves upward as shown in FIG. 15. Furthermore, the mixing channel 28 includes substantially vertically disposed walls 27 that extend from the channel opening to the lower wall, in which case the mixing channel can be said to include that interior space defined by the dome, since any of the first liquid leaving the lower container section could flow freely in that interior space.

Figure 16:
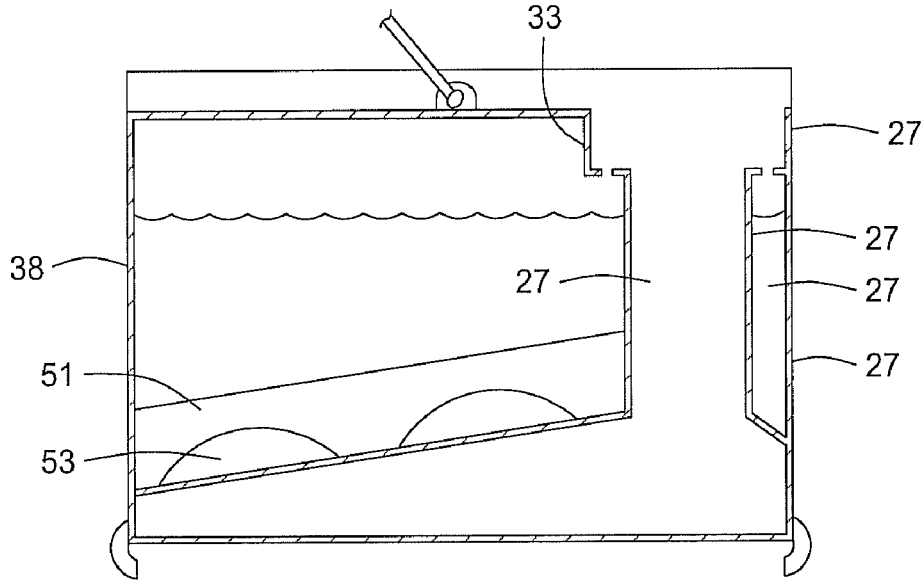
FIG. 16 is a cut-away side view of another example of an upper container section.

Another example of a lower container section, with other features, is disclosed in FIG. 16. Specifically, that container section includes multiple baffles 51, which are planar ribs on the inside surface of the lower wall 36 of the upper container section 24, extending radially from the inside surface of the upper container section side wall 38 to the outer surface of the wall 27 of the mixing channel 28. Preferably, each of the baffles has openings 53 so that the second liquid in the interior space of the upper container section can freely move and does not form individual pools. Also seen in FIG. 16 is a slightly different version of mixing channel than the mixing channels disclosed in the other drawings. The mixing channel 28 has at least two sections, i.e., a first section 28*a* with a first diameter, and a second section 28*b* with a second diameter. The first and second sections 28*a*, 28*b* can be either part of the same unitary piece, e.g., molded as a single part, or they can be two different pieces that are fixedly connected, e.g., by gluing or ultrasonic welding. In either event, the two sections are assembled or configured so that the mixing channel has intermediate channel apertures 26*a*, 26*b* that are vertical, e.g., that provide for the vertical flow of liquid (through aperture 26*a*) and air (through aperture 26*b*).

Yet another version of a mixing channel 28 and apertures 26*a*, 26*b* can be seen in FIG. 17. As seen in that drawing, the intermediate channel apertures 26*a*, 26*b* are vertically directed, as discussed above (i.e., the liquid flows through the mixing channel wall in a generally upward direction, substantially parallel with the pouring axis). Also, as with FIG. 16, the mixing channel includes two parts 28*a*, 28*b*, each having different diameters. The device in FIG. 17, however, also includes a cylindrical insert that is preferably capable of rotating freely around an imaginary axis down the center of the mixing channel. As seen in FIG. 17, the insert is held into place by a lip around the upper part of the upper portion of the mixing channel and also by the ledge connecting the upper portion 28*a* of the mixing channel and the lower portion 28*b* of the mixing channel. The cylindrical insert has apertures 28*c*, 28*d* that are capable of aligning with the apertures 26*b*, 26*a*. Accordingly, the insert can be rotated to a first position, wherein insert aperture 28*c* aligns with intermediate channel aperture 26*b* and insert aperture 28*d* aligns with intermediate channel aperture 26*a*. Alternatively, the insert can be rotated to a second position, wherein neither of the insert apertures 28*c*, 28*d* align with either of the intermediate channel apertures 26*a*, 26*b*. In the first position, the intermediate channel apertures are open, so that air and liquid flow through them (in the mixing mode). In the second position the intermediate channel apertures are closed so that neither air nor liquid flows through them (in the non-mixing mode).

In FIG. 18, an alternative version of a two-piece mixing channel is shown, having apertures 26*a*, 26*b* that are vertically directed, but each mixing channel section has cone-shaped sidewalls (although the channel is shown as a cross-section only in order to illustrate the direction of the intermediate channel aperture. Also, referring to FIG. 19, a top view of a second container section is disclosed, showing preferred relative dimensions of the flip-top compared to the dimensions of the mixing channel; and also showing the manner in which the flip top extends past the outer wall of the second container section, to provide for easy opening with a thumb.

Figure 22:
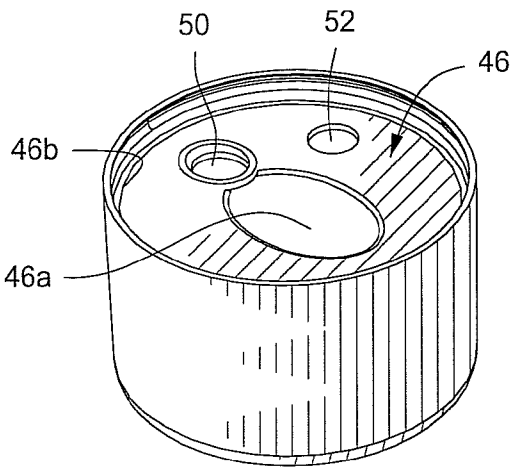
FIG. 22 is a perspective bottom view of the upper container section of FIGS. 20 and 21.
Figure 21:
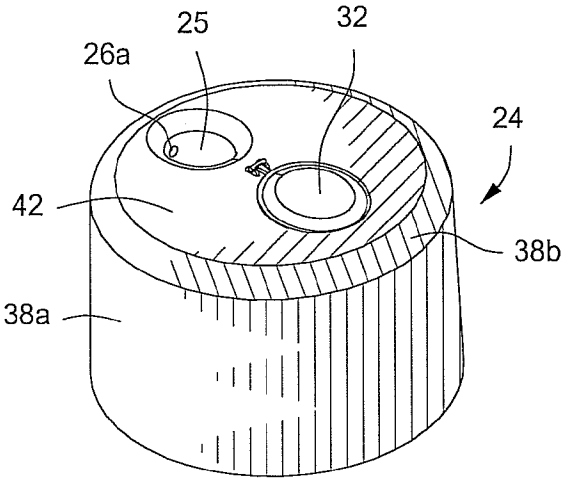
FIG. 21 is a perspective top view of the upper container section of FIG. 20 with the flip-top in an open position.
Figure 20:
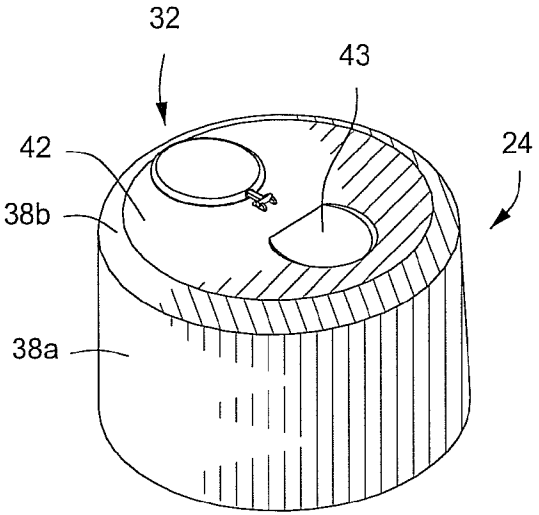
FIG. 20 is a perspective top view of an upper container section with a flip-top in a closed position.
Figure 23:
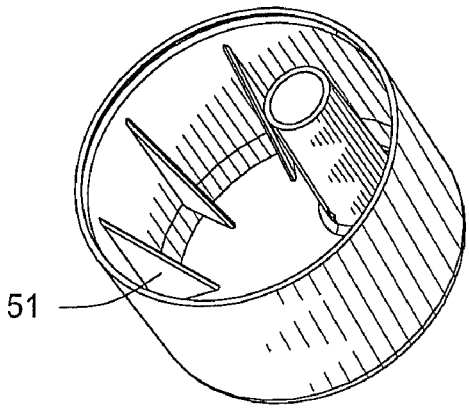
FIG. 23 is a perspective bottom view of another example of an upper container section showing ribs (baffles) and without the lower wall.

Other specific examples of structures are shown in FIGS. 20-23. FIGS. 20 and 21 shown an example of an upper container section 24 that has a flip-top 32 shown in the closed position in FIG. 20 (covering up the upper channel opening) and shown in the open position in FIG. 21 (revealing upper channel opening 25 and intermediate channel aperture 26*a*). The drawing in FIG. 20 shows the recess or indentation 43 in the upper surface of wall 42, which is configured, shaped and sized to accommodate the thumb portion of flip-top 32. Also seen in FIGS. 20 and 21 is the side wall 38 that (in that particular version) includes the substantially vertical wall portion 38*a* and a beveled wall 38*b* that adjoins the vertical side wall 38*a* with the upper surface or wall 42. Referring to FIG. 22, the lower (underside) portions of the upper container section are seen. In this particular embodiment the lower wall 46 includes a recess 46*a* (which has a similar function as the apex of the dome portion 46*a* of wall described in FIG. 15, e.g., it provides space for a pop-top 31 of a typical soft drink can. Also seen in FIG. 22 is an aperture 50 that corresponds to the lower or bottom aperture of channel 28, and also the aperture 52 for filling the interior of the upper container section with a second liquid. In FIG. 23, a specific embodiment is shown that includes baffles 51 that are triangular in shape and vertical and adjoin the inner surface of the side wall 38 of the upper container section. Finally, FIG. 24 illustrates a cut-away portion of a channel 28, including a portion of the inside surface of channel wall 27, and a pressure-adhesive tape affixed to the inside surface of the channel wall 27 over one of the intermediate channel apertures 26*a*. As illustrated, the tape 30 has been partially pulled away to open the aperture 26*a*. That tape 30 has at least one portion that is straight and substantially rigid with no adhesive backing and another portion that is flexible (more flexible than the rigid portion) and has an adhesive surface, and is folded over so that each end of the tape faces upward (relative to the channel). In operation, the individual who wishes to remove the tape so as to open one of the apertures 26*a* simply grasps the straight rigid portion of the tape between his thumb and index finger, and pulls (toward the left as illustrated).

What is claimed as the invention is:

1. A beverage container, comprising:

an integrally formed upper container section configured to engage and be disposed adjacent and above a lower container section that includes a central axis, a wall defining an interior space that is capable of holding a first liquid beverage, and a lower container opening through which the first liquid beverage is capable of flowing, which upper container section includes a superior surface, a peripheral wall extending from said superior surface and defining an interior storage space that is capable of holding a second liquid beverage, said peripheral wall terminating at a peripheral free edge, said peripheral free edge defining a bottom opening of the upper container section; and a mixing channel, which includes:

a channel wall extending from said superior surface and terminating at a channel free edge, said channel free edge defining a channel opening;

an interior mixing channel bounded at least in part by the channel wall;

one or more intermediate openings in the channel wall through which any second liquid beverage is capable of passing from the interior storage space of the upper container section to the interior mixing channel; and an upper opening in the superior surface through which any liquid in the interior mixing channel is capable of passing to a location outside the beverage container, said channel wall terminating at said upper opening; and a portion of said peripheral wall adjacent to said peripheral free edge defining a container attachment sized and configured to grip the lower container opening; and an integrally formed inferior cover attached to said integrally formed upper container section, within the bottom opening of the upper container section, adjacent to said container attachment, said inferior cover including a lower opening in said inferior cover through which any first liquid beverage is capable of passing from the lower container section to the interior mixing channel, said lower opening being aligned with said interior mixing channel; and a sealable fill port in said inferior cover, said fill port being in fluid communication with said interior space of said upper container section; and a removable closure removably covering said upper opening in the superior surface; and a removable seal extending from said upper opening in the superior surface into said interior mixing space and removably covering said one or more intermediate openings in the channel wall.

2. The beverage container of claim 1, wherein at least one of the intermediate openings is smaller than the lower opening.

3. The beverage container of claim 1, wherein at least one of the intermediate openings is positioned at a location in the channel wall that is closer in distance to the upper opening of the mixing channel than to the channel free edge of the mixing channel.

4. The beverage container of claim 1, wherein the interior storage space includes a top portion and a bottom portion, wherein the top portion is positioned above the bottom portion when the upper container section is upright, wherein the bottom portion is capable of holding the second liquid beverage such that the bottom portion is devoid of the second liquid when the upper container section is upright, and wherein at least one of the intermediate openings is positioned at a location in the channel wall in fluid communication with the top portion but not the bottom portion.

5. The beverage container of claim 1, wherein at least one of the intermediate openings is positioned at a location in the channel wall that is closer in distance to the peripheral wall of the upper container section than to the central axis of the lower container section.

6. The beverage container of claim 1, wherein at least one of the intermediate openings is positioned at a location in the channel wall that is closer in distance to the central axis of the lower container section than to the outer wall of the upper container section.

7. The beverage container of claim 1, wherein the one or more intermediate openings in the channel wall includes at least one opening capable of providing for the flow of a second liquid beverage from the upper container section to the interior mixing space; and at least one vent opening capable of providing for the flow of air between the interior mixing space of the mixing channel and the interior of the upper container section.

8. The beverage container of claim 1, wherein the peripheral wall of the upper container section has a concave surface.

9. The beverage container of claim 7, wherein the peripheral wall of the upper container section further includes a planar member positioned in the space bounded by the peripheral wall that provides reinforcement and rigidity to the upper container section.

10. The beverage container of claim 7, wherein the intermediate openings in the channel wall are disposed vertically so that liquid in the upper container section is capable of flowing vertically from the upper container section to the interior mixing space of the mixing channel.

11. The beverage container of claim 1, wherein the mixing channel has a substantially cylindrical side wall.

12. The beverage container of claim 1, wherein the peripheral as a concave surface defining a dome-shaped space between the superior surface and inferior cover.

13. The beverage container of claim 1, wherein the lower container section is a metal soft drink can with a top rim and is capable of holding a soft drink, and said container attachment comprises a resilient collar sized to securely engage the top rim of the soft drink can.

14. The beverage container of claim 1, wherein the lower container section is a plastic soft drink bottle capable of holding a soft drink, and said container attachment comprises a female threaded opening.

15. The beverage container of claim 1, wherein the removable closure comprises a hinged lid capable of rotating from a closed position in which the upper opening in the superior surface is closed, to an open position in which the upper opening of the superior surface is open.

16. The beverage container of claim 1, wherein said container attachment comprises a collar that is capable of attaching the upper container section to the lower container section.

17. The beverage container of claim 1, wherein the sealable fill port comprises a filling aperture through which the second liquid can be introduced to the interior of the upper container section, and a filling aperture closure for sealing the filling aperture.

18. The beverage container of claim 1, wherein the mixing channel includes a flexible planar tab member that has adhesive on one side and is removably adhered to an inner surface of the channel wall so that at least one of the one or more intermediate openings in the channel wall is closed, and so that the flexible planar tab member can be removed to open the intermediate opening.

19. The beverage container of claim 1, wherein the lower container section is a plastic soft drink bottle with a threaded upper opening, the upper container section includes a channel with threads that are capable of being affixed to the threaded upper opening of the soft drink bottle by screwing the upper container section to the lower container in a clockwise direction.

20. The beverage container of claim 1, further comprising a removable closure covering each of said intermediate openings, said removable closure including a pressure-sensitive adhesive tape applied over each intermediate opening, said pressure-sensitive adhesive tape having a top edge and a bottom edge, and an elongated tab extending from the bottom edge of the pressure sensitive adhesive tape through the interior mixing space to and out of the upper opening.

* * * * *